US010675519B1

(12) United States Patent
Gerrick

(10) Patent No.: US 10,675,519 B1
(45) Date of Patent: Jun. 9, 2020

(54) PUTTING CUP

(71) Applicant: Carlton Gerrick, Brampton (CA)

(72) Inventor: Carlton Gerrick, Brampton (CA)

( * ) Notice: Subject to any disclaimer, the term of this patent is extended or adjusted under 35 U.S.C. 154(b) by 0 days.

(21) Appl. No.: 16/680,613

(22) Filed: Nov. 12, 2019

(51) Int. Cl.
*A63B 69/36* (2006.01)
*A63B 57/40* (2015.01)

(52) U.S. Cl.
CPC ..... *A63B 57/40* (2015.10); *A63B 69/3676* (2013.01)

(58) Field of Classification Search
CPC ..... A63B 57/40; A63B 69/3676
USPC ..... 473/180–189
See application file for complete search history.

(56) References Cited

U.S. PATENT DOCUMENTS 3,074,722 A * 1/1963 Davenport ..... A63B 57/357 473/189
3,086,779 A 4/1963 Taylor
3,464,704 A * 9/1969 Nelson ..... A63B 67/02 473/162
3,652,095 A * 3/1972 Furnari ..... A63B 57/40 473/172
3,912,276 A * 10/1975 Keicher ..... A63B 63/00 473/189
5,752,703 A * 5/1998 Wong ..... A63F 9/0204 273/342
D400,631 S 11/1998 Moore
7,128,655 B2 * 10/2006 Jones ..... A63B 57/357 473/180
8,870,672 B2 10/2014 Downing
9,931,557 B1 * 4/2018 Ivone, Jr. ..... A63B 69/36

FOREIGN PATENT DOCUMENTS

GB 1478114 6/1977

* cited by examiner

*Primary Examiner* — Nini F Legesse
(74) *Attorney, Agent, or Firm* — Kyle A. Fletcher, Esq.

(57) ABSTRACT

The putting cup comprises a target cup and a cup holder. The putting cup be a practice accessory for the sport of golfing. A spike located on the cup holder may be pressed into a practice surface. The target cup may be clipped to the cup holder. A golf ball may be putted into the target cup and the target cup may be held in position by the cup holder. As a non-limiting example, the practice surface may be a level surface into which the spike of a clip may be planted, such as a lawn.

18 Claims, 5 Drawing Sheets

PUTTING CUP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sporting equipment, more specifically, a putting cup.

SUMMARY OF INVENTION

The putting cup comprises a target cup and a cup holder. The putting cup be a practice accessory for the sport of golfing. A spike located on the cup holder may be pressed into a practice surface. The target cup may be clipped to the cup holder. A golf ball may be putted into the target cup and the target cup may be held in position by the cup holder. As a non-limiting example, the practice surface may be a level surface into which the spike of a clip may be planted, such as a lawn.

An object of the invention is to provide a target cup for putting practice.

Another object of the invention is to retain the target cup in place using a cup holder comprising a clip.

A further object of the invention is to plant the cup holder into a practice surface using a spike.

Yet another object of the invention is to provide a window on the target cup that allows the interior of the target cup to be viewed.

These together with additional objects, features and advantages of the putting cup will be readily apparent to those of ordinary skill in the art upon reading the following detailed description of the presently preferred, but nonetheless illustrative, embodiments when taken in conjunction with the accompanying drawings.

In this respect, before explaining the current embodiments of the putting cup in detail, it is to be understood that the putting cup is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the putting cup.

It is therefore important that the claims be regarded as including such equivalent construction insofar as they do not depart from the spirit and scope of the putting cup. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
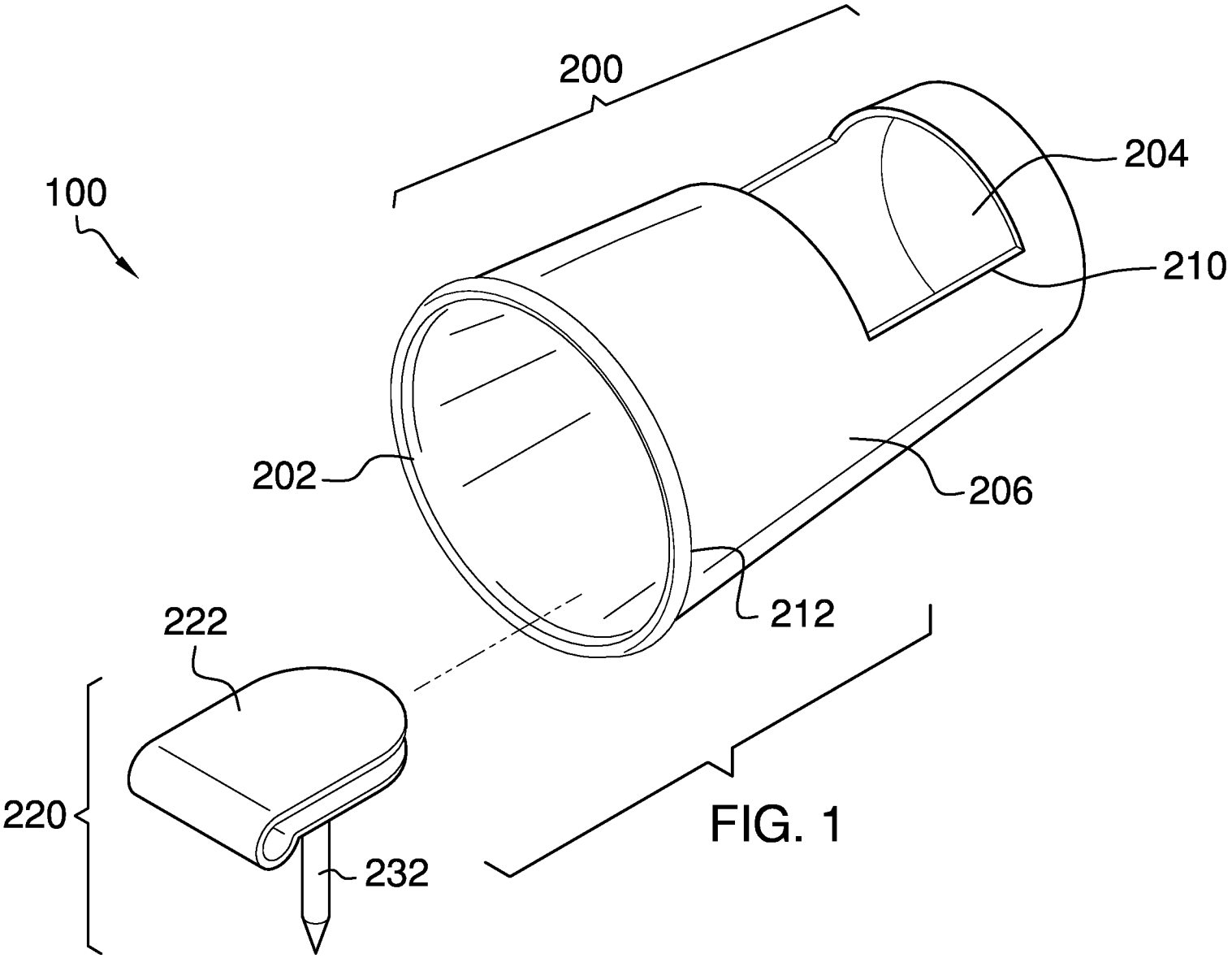
FIG. 1 is an isometric view of an embodiment of the disclosure.
Figure 2:
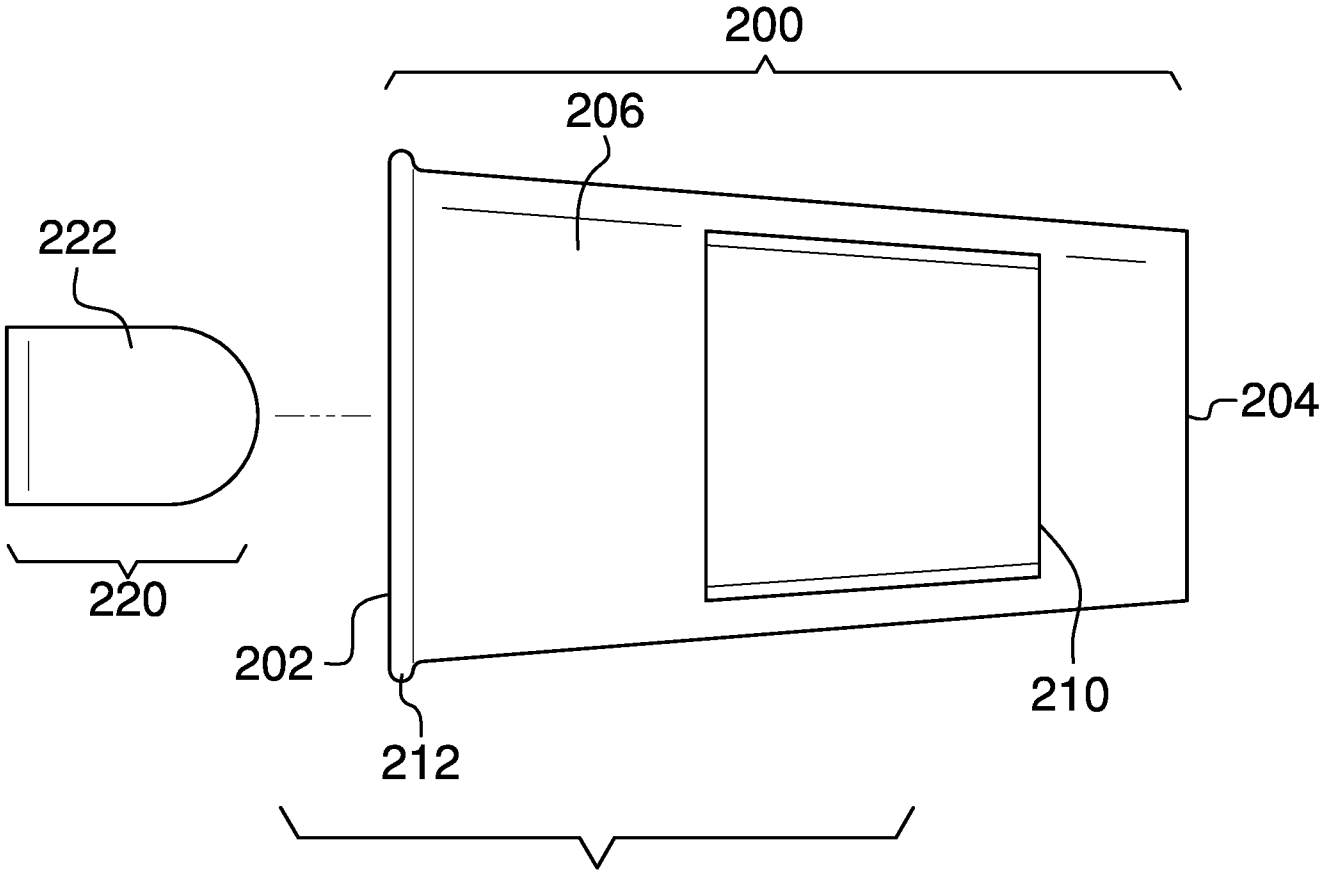
FIG. 2 is a top view of an embodiment of the disclosure.
Figure 3:
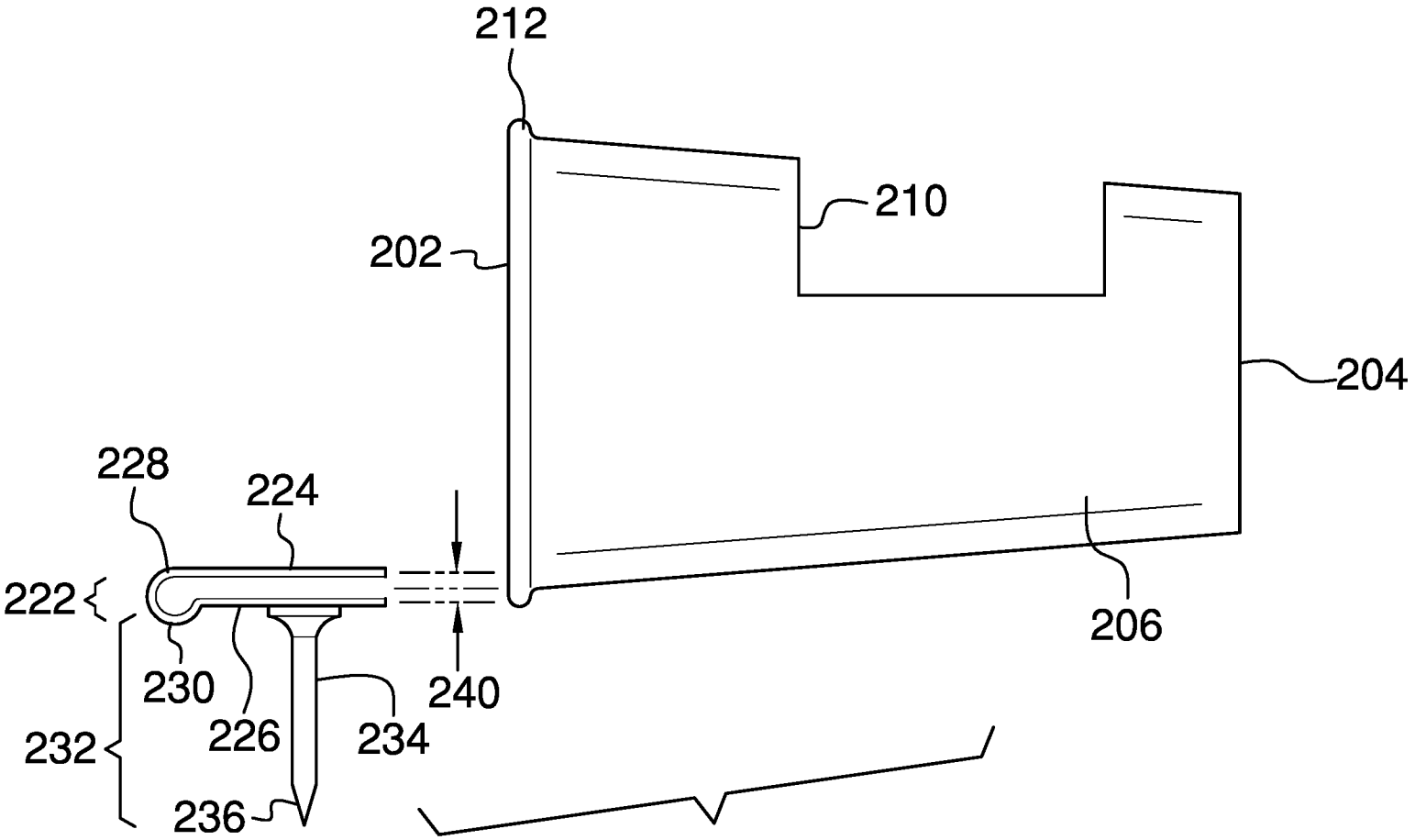
FIG. 3 is a side view of an embodiment of the disclosure.
Figure 4:
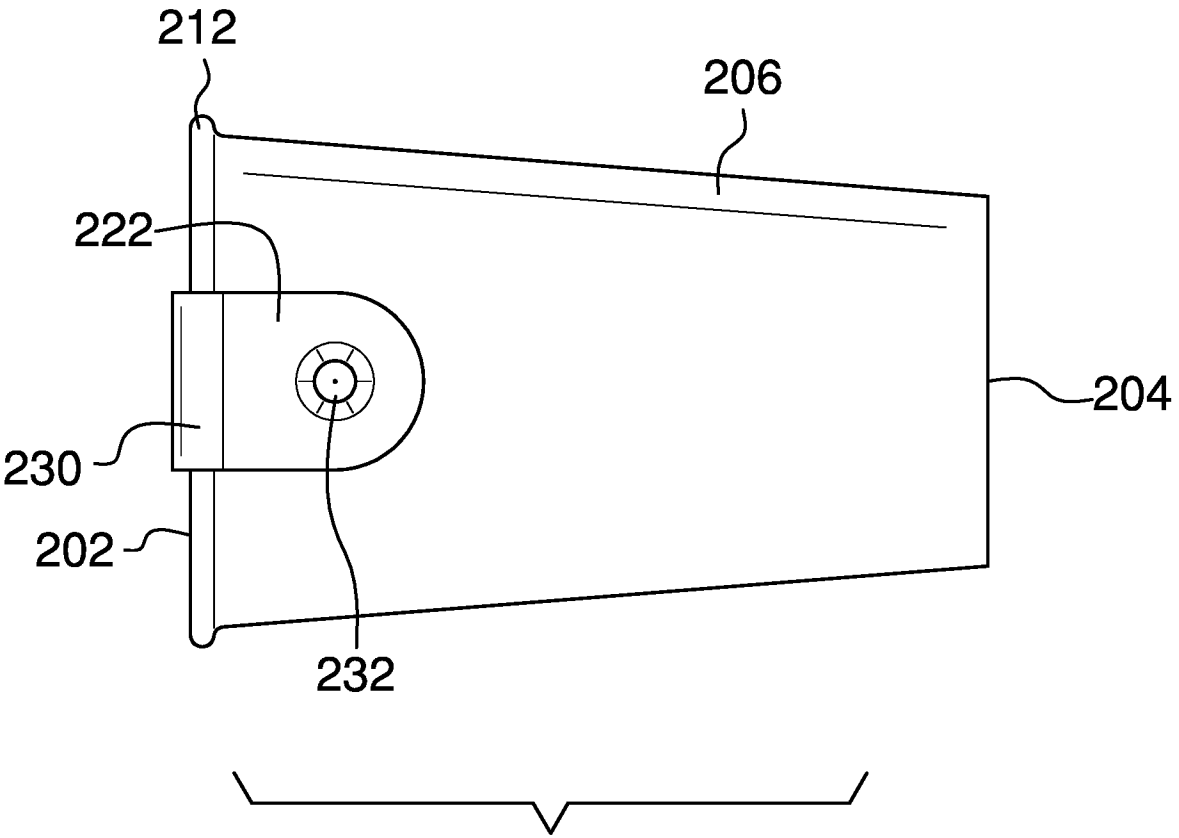
FIG. 4 is a bottom view of an embodiment of the disclosure.
Figure 5:
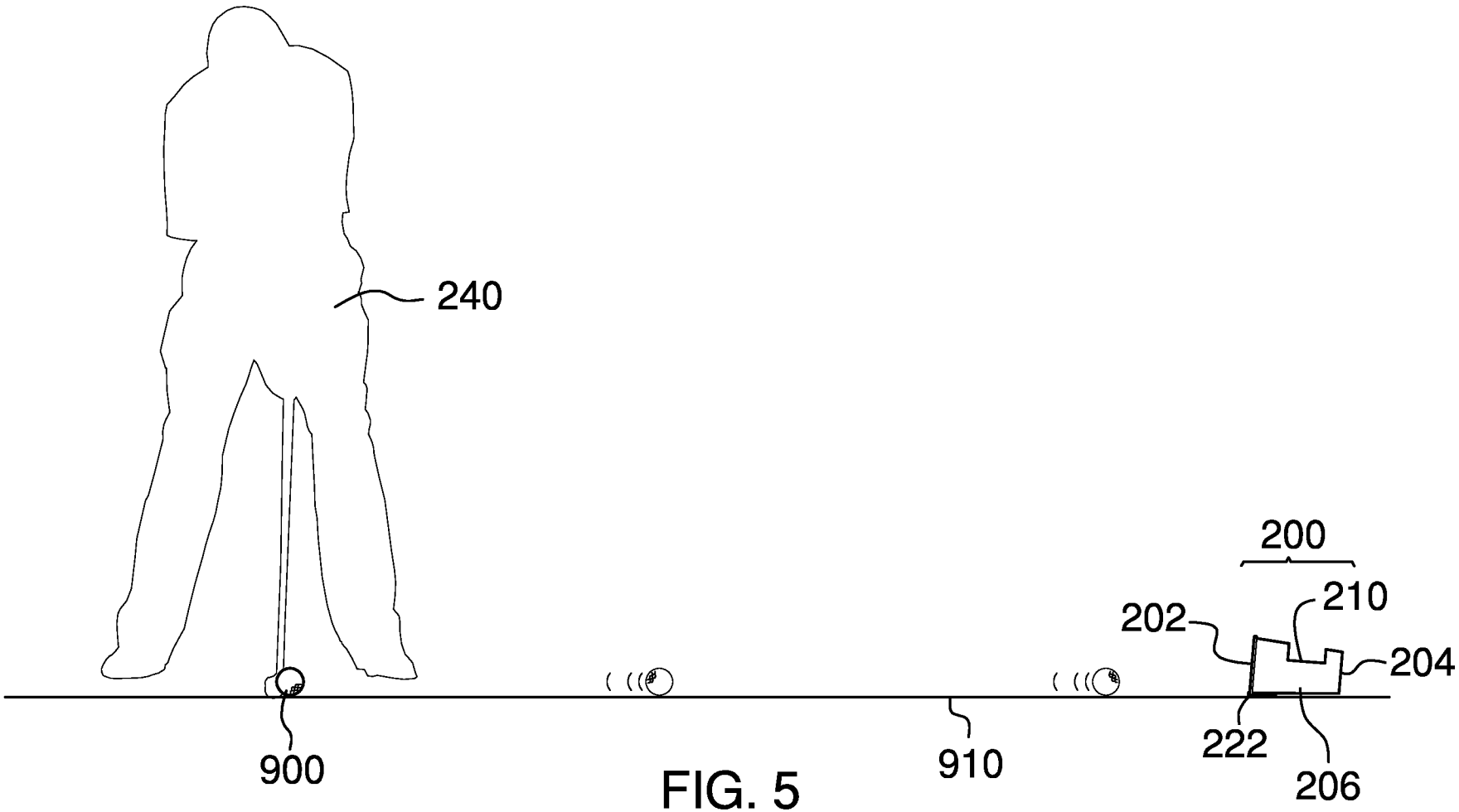
FIG. 5 is an in-use view of an embodiment of the disclosure.

Detailed reference will now be made to a first potential embodiment of the disclosure, which is illustrated in FIGS. 1 through 5.

The putting cup 100 (hereinafter invention) comprises a target cup 200 and a cup holder 220. The invention 100 may be a practice accessory for the sport of golfing. A spike 232 located on the cup holder 220 may be pressed into a practice surface 910. The target cup 200 may be clipped to the cup holder 220. A golf ball 900 may be putted into the target cup 200 and the target cup 200 may be held in position by the cup holder 220. As a non-limiting example, the practice surface 910 may be a level surface into which the spike 232 of a clip 222 may be planted.

The target cup 200 may comprise a target aperture 202, an end stop 204, a side wall 206, a window 210, and a lip 212. The target cup 200 may provide a target to aim for while practicing putting. The target cup 200 may be a horizontally-oriented open container that the golf ball 900 may be putted into. The target aperture 202 may be an opening at the front of the target cup 200 for the golf ball 900 to enter the target cup 200. The diameter of the target aperture 202 may be larger than the diameter of the golf ball 900. The target aperture 202 may be bounded by the lip 212. The lip 212 may be a thickening of the side wall 206 adjacent to the target aperture 202. The end stop 204 may be a planar wall at the rear of the target cup 200 that stops the golf ball 900 from passing completely through the target cup 200. The side wall 206 may be a curved wall that surrounds the target cup 200. The side wall 206 may couple the lip 212 to the perimeter of the end stop 204. In some embodiments, the cross-sectional diameter of the target cup 200 may taper front to rear such that the end stop 204 has a smaller diameter than the target aperture 202.

The window 210 may be an opening in the side wall 206 which provides visibility to the interior of the target cup 200. The window 210 may be adapted to allow a golfer 940 to determine if the golf ball 900 is inside of the target cup 200.

The cup holder 220 may comprise the clip 222 and the spike 232. The cup holder 220 may hold the lip 212 of the target cup 200 such that the target cup 200 does not move when struck by the golf ball 900. The clip 222 may comprise an upper plate 224, a lower plate 226, and a joint 228. The clip 222 may removably couple to the lip 212 of the target cup 200.

The upper plate 224 and the lower plate 226 may be parallel plates that are horizontally-oriented. The upper plate 224 may be located directly above the lower plate 226. The upper plate 224 and the lower plate 226 may be identical shapes. The joint 228 may be a C-shaped bend in the clip 222. The front of the upper plate 224 may couple to top of the joint 228. The front of the lower plate 226 may couple to the bottom of the joint 228. The upper plate 224, the lower plate 226, and the joint 228 may be made from a semi-rigid material. A separation distance 240 between the upper plate 224 and the lower plate 226 may be less than the thickness of the lip 212 such that the clip 222 must flex to widen the separation distance 240 in order for the target cup 200 to be placed into the clip 222.

The joint 228 may comprise an offset 230 which is a widening of the joint 228. The diameter of the joint 228 measured vertically at the offset 230 may be wider than the separation distance 240 and may be wider than the thickness of the lip 212.

The spike 232 may comprise a shaft 234 and a point 236. The spike 232 may be planted into the practice surface 910 in order to prevent the clip 222 from moving horizontally. The shaft 234 may be a vertical armature coupled to the clip 222 at the top end of the shaft 234 and shaped to the point 236 on the bottom end of the shaft 234. The point 236 may be a tapering of the shaft 234 that allows the spike 232 to be pressed into the practice surface 910.

In use, the cup holder 220 is positioned by pressing the spike 232 into the practice surface 910 and pressing down until the bottom of the clip 222 is against the practice surface 910. The target cup 200 is placed on the side wall 206 in front of the clip 222 with the window 210 facing up. The target cup 200 is forced into the clip 222 such that the lip 212 of the target cup 200 increases the separation distance 240 between the upper plate 224 and the lower plate 226 and the lip 212 passes between them. When the lip 212 reaches the joint 228, the upper plate 224 and the lower plate 226 may return to their original positions. The target cup 200 may be captured by the lip 212 with the side wall 206 between the upper plate 224 and the lower plate 226. The golfer 940 may step away from the target cup 200, place the golf balls 900 onto the practice surface 910, and practice putting the golf balls 900 into the target cup 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "accessory" is a second object that adds to the convenience or attractiveness of a first object. In some instances, an accessory may extend the functionality of the first object by allowing the combination of the accessory plus the first object to perform a task that the first object could not perform alone.

As used in this disclosure, an "aperture" is an opening in a surface. Aperture may be synonymous with hole, slit, crack, gap, slot, or opening.

As used in this disclosure, a "boundary" refers to a line segment or surface that forms a some or all of the perimeter of a first space and some or all of the perimeter of a second space. Stated less formally, the boundary forms at least part of the delineation between the first space and the second space. When identifying a boundary within this disclosure, a first space may be said to "be bounded" by one or more additional spaces.

As used in this disclosure, a "clip" is a fastener that attaches to an object by gripping or clasping the object. A clip is typically spring loaded.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, a "perimeter" is one or more curved or straight lines that bound an enclosed area on a plane or surface. The perimeter of a circle is commonly referred to as a circumference.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

As used in this disclosure, the term "shaft" is used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "taper" is a continuous and typically, but not necessarily, gradual change in the span of a one or more dimensions of an elongated object that occurs in the apparent direction of elongation. An object that narrows along an axis may be called tapered.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A putting cup comprising:
a target cup and a cup holder;
wherein the putting cup is a practice accessory for the sport of golfing;
wherein a spike located on the cup holder is pressed into a practice surface;
wherein the target cup is clipped to the cup holder;
wherein a golf ball is putted into the target cup and the target cup is held in position by the cup holder;
wherein the target cup comprises a target aperture, an end stop, a side wall, a window, and a lip;
wherein the target cup provides a target to aim for while practicing putting;
wherein the target cup is a horizontally-oriented open container that the golf ball is putted into;
wherein the target aperture is bounded by the lip;
wherein the lip is a thickening of the side wall adjacent to the target aperture.

2. The putting cup according to claim 1
wherein the target aperture is an opening at a front of the target cup for the golf ball to enter the target cup.

3. The putting cup according to claim 2
wherein a diameter of the target aperture is larger than the diameter of the golf ball.

4. The putting cup according to claim 3
wherein the end stop is a planar wall at a rear of the target cup that stops the golf ball from passing completely through the target cup.

5. The putting cup according to claim 4
wherein the side wall is a curved wall that surrounds the target cup.

6. The putting cup according to claim 5
wherein the side wall couples the lip to the perimeter of the end stop.

7. The putting cup according to claim 6
wherein a cross-sectional diameter of the target cup tapers front to rear such that the end stop has a smaller diameter than the target aperture.

8. The putting cup according to claim 7
wherein the window is an opening in the side wall which provides visibility to an interior of the target cup.

9. The putting cup according to claim 8
wherein the cup holder comprises a clip and the spike;
wherein the cup holder holds the lip of the target cup such that the target cup does not move when struck by the golf ball;
wherein the clip comprises an upper plate, a lower plate, and a joint.

10. The putting cup according to claim 9
wherein the clip removably couples to the lip of the target cup.

11. The putting cup according to claim 10
wherein the upper plate and the lower plate are parallel plates that are horizontally-oriented;
wherein the upper plate is located directly above the lower plate;
wherein the upper plate and the lower plate are identical shapes.

12. The putting cup according to claim 11
wherein the joint is a C-shaped bend in the clip.

13. The putting cup according to claim 12
wherein the front of the upper plate couples to top of the joint;
wherein the front of the lower plate couples to the bottom of the joint;
wherein the upper plate, the lower plate, and the joint are made from a semi-rigid material.

14. The putting cup according to claim 13
wherein a separation distance between the upper plate and the lower plate is less than the thickness of the lip such that the clip must flex to widen the separation distance in order for the target cup to be placed into the clip.

15. The putting cup according to claim 14
wherein the joint comprises an offset which is a widening of the joint;
wherein the diameter of the joint measured vertically at the offset is wider than the separation distance and is wider than the thickness of the lip.

16. The putting cup according to claim 15
wherein the spike comprises a shaft and a point;
wherein the spike is planted into the practice surface in order to prevent the clip from moving horizontally.

17. The putting cup according to claim 16
wherein the shaft is a vertical armature coupled to the clip at the top end of the shaft and shaped to the point on the bottom end of the shaft.

18. The putting cup according to claim 17 wherein the point is a tapering of the shaft that allows the spike to be pressed into the practice surface.

* * * * *